US010077639B2

(12) United States Patent
Fleming

(10) Patent No.: US 10,077,639 B2
(45) Date of Patent: Sep. 18, 2018

(54) METHODS AND SYSTEMS FOR NON-PHYSICAL ATTRIBUTE MANAGEMENT IN RESERVOIR SIMULATION

(71) Applicant: LANDMARK GRAPHICS CORPORATION, Houston, TX (US)

(72) Inventor: Graham Christopher Fleming, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 861 days.

(21) Appl. No.: 14/407,911

(22) PCT Filed: May 28, 2013

(86) PCT No.: PCT/US2013/042843

§ 371 (c)(1),
(2) Date: Dec. 12, 2014

(87) PCT Pub. No.: WO2013/188091

PCT Pub. Date: Dec. 19, 2013

(65) Prior Publication Data

US 2015/0168598 A1 Jun. 18, 2015

Related U.S. Application Data

(60) Provisional application No. 61/660,645, filed on Jun. 15, 2012.

(51) Int. Cl.
*E21B 43/00* (2006.01)

(52) U.S. Cl.
CPC ..... *E21B 43/00* (2013.01)

(58) Field of Classification Search
CPC ..... E21B 43/00; G06F 17/5009
See application file for complete search history.

(56) References Cited

U.S. PATENT DOCUMENTS 5,710,726 A * 1/1998 Rowney ..... E21B 49/00 703/10
5,992,519 A * 11/1999 Ramakrishnan ..... E21B 43/12 166/250.01

(Continued)

FOREIGN PATENT DOCUMENTS

| | | |
|---|---|---|
| CA | 2616816 | 2/2007 |
| WO | 2002/003103 | 1/2002 |
| WO | 2008/020906 | 2/2008 |

OTHER PUBLICATIONS

Younis, R.M. et al., "Adaptively Localized Continuation-Newton Method-Nonlinear Solvers that Converge All the Time," Society of Petroleum Engineers (SPE), SPE 119147 (2009).*

(Continued)

*Primary Examiner* — Jay B Hann
(74) *Attorney, Agent, or Firm* — Alan Bryson; Parker Justiss, P.C.

(57) ABSTRACT

A disclosed method for a hydrocarbon production system includes collecting production system data. The method also includes performing a simulation based on the collected data, a fluid model, and a fully-coupled set of equations. The method also includes expediting convergence of a solution for the simulation by reducing occurrences of non-physical attributes during the simulation. The method also includes storing control parameters determined for the solution for use with the production system.

20 Claims, 6 Drawing Sheets

(56) References Cited

U.S. PATENT DOCUMENTS

| | | | | |
|---|---|---|---|---|
| 6,052,520 | A | 4/2000 | Watts, III | |
| 6,662,146 | B1 | 12/2003 | Watts | |
| 7,672,818 | B2 | 3/2010 | Watts | |
| 8,190,405 | B2 * | 5/2012 | Appleyard | E21B 43/00 703/2 |
| 8,204,727 | B2 * | 6/2012 | Dean | E21B 43/26 703/10 |
| 8,301,429 | B2 * | 10/2012 | Hajibeygi | G06F 17/5018 703/10 |
| 2006/0036418 | A1 | 2/2006 | Pita et al. | |
| 2007/0112547 | A1 | 5/2007 | Ghorayeb et al. | |
| 2007/0118346 | A1 | 5/2007 | Wen et al. | |
| 2010/0076738 | A1 | 3/2010 | Dean et al. | |
| 2010/0094605 | A1 | 4/2010 | Hajibeygi et al. | |
| 2010/0142323 | A1 | 6/2010 | Chu et al. | |
| 2011/0061860 | A1 | 3/2011 | Dean et al. | |
| 2012/0232861 | A1 | 9/2012 | Lu et al. | |
| 2013/0166264 | A1 * | 6/2013 | Usadi | G06F 17/5009 703/2 |

OTHER PUBLICATIONS

"EP Examination Report", dated Jun. 8, 2017, Appl No. 13804315.3, "Methods and Systems for Non-Physical Attribute Management in Reservoir Simulation," Filed May 28, 2013, 5 pgs.

PCT International Search Report and Written Opinion, dated Nov. 12, 2013, Appl No. PCT/US2013/042843, "Methods and Systems for Non-Physical Attribute Management in Reservoir Simulation", filed May 28, 2013, 15 pgs.

PCT International Preliminary Report on Patentability, dated Jun. 13, 2013, Appl No. PCT/US2013/042843, "Methods and Systems for Non-Physical Attribute Management in Reservoir Simulation", filed May 28, 2013, 19 pgs.

AU Examination Report No. 1, dated Aug. 14, 2015 "Methods and Systems for Non-Physical Attribute Management in Reservoir Simulation" Appln No. 2013274734 filed May 27, 2013.

Younis, R.M. et al., "Adaptively Localized Continuation-Newton Method-Nonlinear Solvers that Converge All the Time," Society of Petroleum Engineers (SPE), Stanford University, 2009, 19 pgs.

Vinsome P.K.W., "Fully Implicit Versus Dynamic Implicit Reservoir Simulation", JCPT85-02-03, Journal of Canadian Petroleum Technology, Mar.-Apr. 1985, pp. 49-53, vol. 24, No. 02.

EP Search Report, dated Feb. 5, 2016 Methods and Systems for Non-Physical Attribute Management in Reservoir Simulation Appln No. 13/804315.3 filed May 28, 2013, 9 pgs.

CA Office Action, dated Oct. 14, 2016, Appl No. 2,874,978, "Methods and Systems for Non-Physical Attribute Management in Reservoir Simulation," Filed May 28, 2013, 6 pgs.

AU Examination Report No. 2, dated May 17, 2016, Appl No. 2013274734, "Methods and Systems for Non-Physical Attribute Management in Reservoir Simulation," filed May 28, 2013.

GCC Exmination Report, dated Jul. 19, 2016, Appl No. 24643, "Method to Reduce Non-Physical Masses and Saturations in Reservoir Simulation," Filed Jun. 12, 2013.

Shiralkar, G.S., "Development and Field Application of a High Performance, Unstructured Simulator with Parallel Capability," SPE 93080, SPE Reservoir Simulation Symposium, Jan. 31-Feb. 2, 2005, 10 pages.

* cited by examiner

METHODS AND SYSTEMS FOR NON-PHYSICAL ATTRIBUTE MANAGEMENT IN RESERVOIR SIMULATION

CROSS-REFERENCE TO RELATED APPLICATIONS

This application claims priority to Provisional U.S. Application Ser. No. 61/660,645, titled "Method to Reduce Non-Physical Masses and Saturations in Reservoir Simulation" and filed Jun. 15, 2012 by Graham Christopher Fleming, which is hereby incorporated herein by reference.

BACKGROUND

Oil field operators dedicate significant resources to improve the recovery of hydrocarbons from reservoirs while reducing recovery costs. To achieve these goals, reservoir engineers both monitor the current state of the reservoir and attempt to predict future behavior given a set of current and/or postulated conditions. Reservoir monitoring, sometimes referred to as reservoir surveillance, involves the regular collection and monitoring of measured data from within and around the wells of a reservoir. Such data may include, but is not limited to, water saturation, water and oil cuts, fluid pressure and fluid flow rates. As the data is collected, it is archived into a historical database.

The collected production data, however, mostly reflects conditions immediately around the reservoir wells. To provide a more complete picture of the state of a reservoir, simulations are executed that model the overall behavior of the entire reservoir based on the collected data, both current and historical. These simulations predict the reservoir's overall current state, producing simulated data values both near and at a distance from the wellbores. Simulated near-wellbore data can be correlated against measured near-wellbore data, and modeled parameters are adjusted as needed to reduce the error between the simulated and measured data. Once so adjusted, the simulated data, both near and at a distance from the wellbore, may be relied upon to assess the overall state of the reservoir. Such data may also be relied upon to predict the future behavior of the reservoir based upon either actual or hypothetical conditions input by an operator of the simulator. Reservoir simulations, particularly those that perform full physics numerical simulations of large reservoirs, are computationally intensive and can take hours, even days to execute.

BRIEF DESCRIPTION OF THE DRAWINGS

A better understanding of the various disclosed embodiments can be obtained when the following detailed description is considered in conjunction with the attached drawings, in which.

Figure 1:
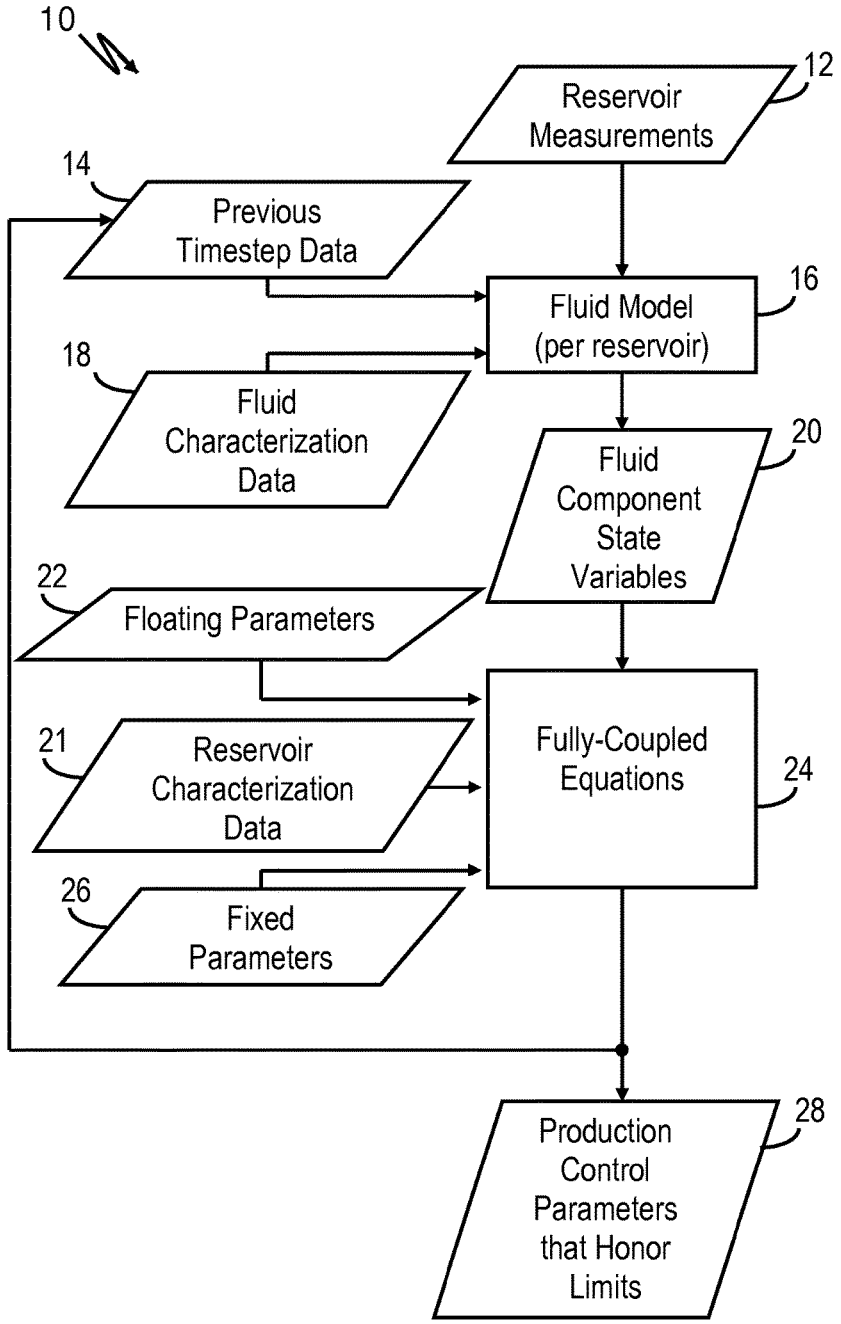
FIG. 1 shows an illustrative simulation process.

It should be understood that the drawings and corresponding detailed description do not limit the disclosure, but on the contrary, they provide the foundation for understanding all modifications, equivalents, and alternatives falling within the scope of the appended claims.

DETAILED DESCRIPTION

Disclosed herein are methods and systems for managing occurrences of non-physical attributes during simulation of a hydrocarbon production system. As used herein, "non-physical attributes" refer to negative values for saturation levels, mass, or other attributes that do not exist in nature. Such non-physical attributes sometimes are calculated during simulations that model the behavior of reservoirs due to imperfect models, approximations, and/or tolerance levels. A hydrocarbon production system being simulated may include multiple wells, a surface network, and a facility. The production of hydrocarbons from one or more reservoirs feeding a surface network and facility involves various management operations to throttle production up or down. As fluids are extracted from the reservoir, the remaining fluids undergo changes to pressure, direction of flow, and/or other attributes that affect future production. The disclosed non-physical attribute management techniques identify and handle occurrences of non-physical attributes as part of an effort to expedite convergence of an overall hydrocarbon production system solution. As an example, the overall hydrocarbon production system solution may align well production with surface network and facility production limits, and throttle well production over time as needed to maintain production at or near facility production limits.

In some embodiments, the overall hydrocarbon production system solution is determined by modeling the behavior of production system components using various parameters. More specifically, separate equations and parameters may be applied to estimate the behavior of fluids in one or more reservoirs, in individual production wells, in the surface network, and/or in the facility. Solving such equations independently or at a single moment in time yields a disjointed and therefore sub-optimal solution (i.e., the production rate and/or cost of production over time is sub-optimal). In contrast, solving such equations together (referred to herein as solving fully-coupled equations) at multiple time steps involves more iterations and processing, but yields a more optimal solution. In alternative embodiments, the non-physical attribute management techniques described herein may be applied to solve reservoir equations independent of an overall production system solution. Further, in different embodiments, the reservoir equations (related to the non-physical attribute management techniques) and other productions system equations may be fully-coupled, loosely-coupled or iteratively coupled.

Hydrocarbon production systems can be modeled using many different equations and parameters. Accordingly, it should be understood that the disclosed equations and parameters are examples only and are not intended to limit embodiments to a particular equation or set of equations. The disclosed embodiments illustrate an example strategy of managing occurrences of non-physical attributes to expedite convergence of equations that model reservoir behavior.

More specifically, hydrocarbon production simulation involves estimating or determining the material components of a reservoir and their state (phase saturations, pressure, temperature, etc.). The simulation further estimates the movement of fluids within and out of the reservoir once production wells are taken into account. The simulation also may account for various enhanced oil recovery (EOR) techniques (e.g., use of injection wells, treatments, and/or gas lift operations). Finally, the simulation may account for various constraints that limit production or EOR operations. With all of the different parameters that could be taken into account by the simulation, management decisions have to be made regarding the trade-off between simulation efficiency and accuracy. In other words, the choice to be accurate for some simulation parameters and efficient for other parameters is an important strategic decision that affects production costs and profitability.

FIG. 1 shows an illustrative simulation process 10 to determine a production system solution as described herein. As shown, the simulation process 10 employs a fluid model 16 to determine fluid component state variables 20 that represent the reservoir fluids and their attributes. The inputs to the fluid model 16 may include measurements or estimates such as reservoir measurements 12, previous timestep data 14, and fluid characterization data 18. The reservoir measurements 12 may include pressure, temperature, fluid flow or other measurements collected downhole near the well perforations, along the production string, at the wellhead, and/or within the surface network (e.g., before or after fluid mixture points). Meanwhile, the previous timestep data 14 may represent updated temperatures, pressures, flow data, or other estimates output from a set of fully-coupled equations 24. Fluid characterization data 18 may include the reservoir's fluid components (e.g., heavy crude, light crude, methane, etc.) and their proportions, fluid density and viscosity for various compositions, pressures and temperatures, or other data.

Based on the above-described data input to the fluid model 16, parameters and/or parameter values are determined for each fluid component or group of components of the reservoir. The resulting parameters for each component/group are then applied to known state variables to calculate unknown state variables at each simulation point (e.g., at each "gridblock" within the reservoir, at wellbore perforations or "the sandface," and/or within the surface network). These unknown variables may include a gridblock's liquid volume fraction, solution gas-oil ratio and formation volume factor, just to name a few examples. The resulting fluid component state variables, both measured and estimated, are provided as inputs to the fully-coupled equations 24. As shown, the fully-coupled equations 24 also receive floating parameters 22, fixed parameters 26, and reservoir characterization data 21 as inputs. Examples of floating parameters 22 include EOR parameters such as gas lift injection rates. Meanwhile, examples of fixed parameters 26 include facility limits (a production capacity limit and a gas lift limit) and default production rates for individual wells. Reservoir characterization data 21 may include geological data describing a reservoir formation (e.g., log data previously collected during drilling and/or prior logging of the well) and its characteristics (e.g., porosity).

The fully-coupled equations 24 model the entire production system (reservoir(s), wells, and surface system), and account for EOR operations and facility limits as described herein. In some embodiments, Newton iterations (or other efficient convergence operations) are used to estimate the values for the floating parameters 22 used by the fully-coupled equations 24 until a production system solution within an acceptable tolerance level is achieved. The output of the solved fully-coupled equations 24 include production control parameters 28 (e.g., individual well parameters and/or EOR operating parameter) that honor facility and EOR limits. The simulation process 10 can be repeated for each of a plurality of different timesteps, where various parameters values determined for a given timestep are used to update the simulation for the next timestep. As described herein, the disclosed embodiments reduce the occurrence of non-physical attributes during simulation to expedite a solution to the fully-coupled equations 24. Example non-physical attributes include negative masses and/or negative saturation that need to be accounted for to expedite solving a mass/volume balance portion of the fully-coupled equations 24.

In at least some embodiments, the production control parameters 28 output from the simulation process 10 enable production output from the wells to match a facility production limit. However, if EOR limits are exceeded, the production output from the wells will decrease over time because they cannot be further enhanced. Once the solution has been determined within an acceptable tolerance, further simulations can be avoided or reduced in number since production levels can be throttled up or down as needed to match a facility production limit using swing wells and/or available EOR operations. As previously noted, the simulation process 10 can be executed for different timesteps (months or years into the future) to predict how the behavior of a hydrocarbon production system will change over time and how to manage production control options.

Figure 2:
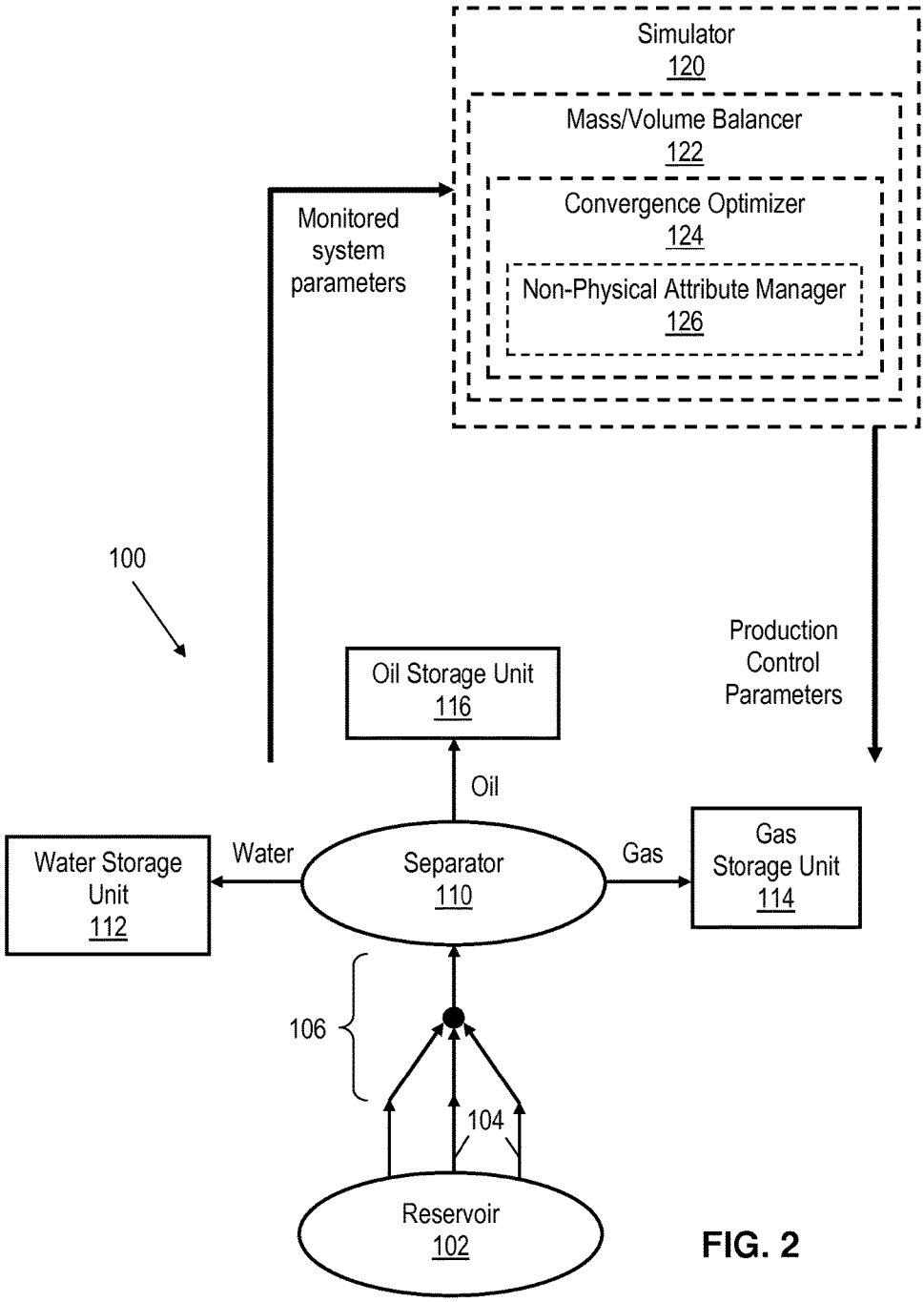
FIG. 2 shows an illustrative hydrocarbon production system.

FIG. 2 shows an illustrative hydrocarbon production system 100. The illustrated hydrocarbon production system 100 includes a plurality of wells 104 extending from a reservoir 102, where the arrows representing the wells 104 show the direction of fluid flow. A surface network 106 transports fluid from the wells 104 to a separator 110, which directs water, oil, and gas to separate storage units 112, 114, and 116. The water storage unit 112 may direct collected water back to reservoir 102 or elsewhere. The gas storage unit 114 may direct collected gas back to reservoir 102, to a gas lift interface 118, or elsewhere. The oil storage unit 116 may direct collected oil to one or more refineries. In different embodiments, the separator 110 and storage units 112, 114, and 116 may be part of a single facility or part of multiple facilities associated with the hydrocarbon production system 100. Although only one oil storage unit 116 is shown, it should be understood that multiple oil storage units may be used in the hydrocarbon production system 100. Similarly, multiple water storage units and/or multiple gas storage units may be used in the hydrocarbon production system 100.

In FIG. 2, the hydrocarbon production system 100 is associated with a simulator 120 corresponding to software run by one or more computers. The simulator 120 receives monitored system parameters from various components of the hydrocarbon production system 100, and determines various production control parameters for the hydrocarbon production system 100. In accordance with at least some embodiments, the simulator 120 performs the operations of the simulation process 10 discussed in FIG. 1.

As shown, the simulator 120 includes a mass/volume balancer 122 that estimates the behavior of reservoir fluids and the effect of fluid extraction during the simulation. The mass/volume balancer 122 employs a convergence optimizer 124 that expedites convergence of a hydrocarbon production system solution. More specifically, the convergence optimizer 124 utilizes a non-physical attribute manager 126 to handle occurrences of non-physical attributes (e.g., negative mass and/or negative saturation) and to reduce the number of occurrences.

In at least some embodiments, the simulator 120 employs a fully implicit method (FIM) that uses Newton's method to solve a non-linear system of equations. Other methods of modeling reservoir simulation are also contemplated herein. For example, U.S. Pat. No. 6,662,146, Methods For Performing Reservoir Simulation, by James W. Watts, describes a mixed implicit-IMPES method, as well as the FIM method, and is incorporated herein by reference in its entirety. In Newton's method, a function f(x)=0 is assumed and a first guess for the solution, $x^0$, is performed. Subsequent iterative guesses are performed to find a solution using the equations:

$$f'(x^{n})dx^{n+1}=-f(x^{n}) \tag{1}$$

$$x^{n+1}=x^{n}+dx^{n+1} \tag{2}$$

These equations are iterated until the residual (the right hand side of equation (1)) is within an acceptable tolerance of zero. However, if the function f is very non-linear, or has discontinuous derivatives, Newton's method may converge slowly, or even fail to converge. In this case, the solution may be damped (or relaxed) to improve convergence.

Figure 3:
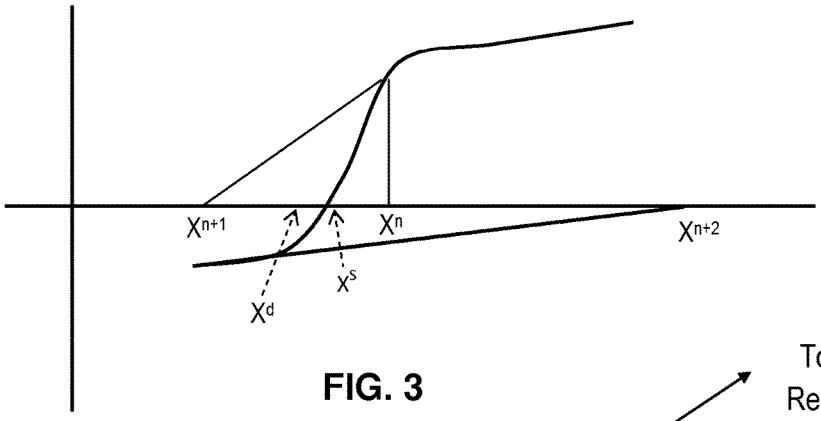
FIG. 3 shows an illustrative application of Newton's method.

Referring to FIG. 3, on iteration n+1, Newton's method calculates a new estimate of the solution, $x^{n+1}$, which is further away from the desired solution, $x^S$, than the value at the start of the iteration, $x^n$. The value for the next iteration, $x^{n+2}$, would move even further away from the desired solution. To speed up convergence (or in some cases to avoid divergence), the iteration may be damped. The damping process involves applying a damp factor that multiplies the calculated linear change in the solution, $dx^{n+1}$. For example, if a damp factor of 0.5 is applied to the example in FIG. 3, the solution is moved to the point $x^d$, which would be a much better approximation to the desired solution.

In accordance with embodiments, equations (1) and (2) are extended to apply to a set of partial differential equations for reservoir simulation. The reservoir may be discretized into many grid blocks, and the solution to the equations may be approximated by the pressure and component masses at each grid block. Other independent variables may also be used. The equations for fluid flow in a reservoir involve many situations where the derivatives are discontinuous, which makes it difficult for Newton's method to converge. In particular, the relative permeabilities of each phase become zero at a saturation of that phase that is usually greater than zero, called the residual saturation. For saturations below this residual saturation, the phase is not mobile.

To stabilize the numerical solution, upstream weighting (sometimes called upwinding) of the fluid mobilities may be used. The flow between two grid blocks, grid block i and grid block j, depends on the potential difference, $\Delta\Phi=\Phi_i-\Phi_j$, between the two grid blocks (i.e., the difference in pressure plus the difference in the gravitational head). For upstream weighting, the relative permeability of a phase is evaluated at the grid block where the potential is greater (i.e., grid block i if $\Delta\Phi$ is negative). Upstream weighting can cause problems if the sign of the potential difference at the start of the iteration is different from the sign of the potential difference at the end of the iteration. This is particularly true if the downstream grid block is at or near the residual saturation for one or more of the phases, and the upstream grid block is not. In this case, fluid can flow out of the downstream grid block, because the potential calculated for the iteration reverses, but the fluid mobilities used to assemble the equations were greater than zero. The result is that the calculated fluid saturations can be less than residual (which is physically incorrect) or worse, the calculated component masses can be negative.

To reduce the occurrence of non-physical masses and saturations, disclosed embodiments avoid negative mobilities. More specifically, if a calculated mobility for a given component is determined to change from positive to negative during an iteration, one or more damp factors are applied to at least some of the components. The damp factors change the mass of each component to a physical value while maintaining the volume balance. If not all components can maintain a positive mobility for the iteration, the non-physical attribute management operations drop the volume balance condition, but maintain non-negative masses.

Because a uniform damp factor need not be applied to all variables, the disclosed technique applies a simple method to find a better starting point for the next iteration than the result of Newton's method. In the case of flow reversals in reservoir simulation, an important factor in determining the correct flow direction is the pressure solution. Accordingly, the disclosed technique avoids damping the pressure solution. In some embodiments, during the process of calculating all the coefficients for the Jacobian matrix, the component mobilities and derivatives with respect to pressure and component mass will have been calculated. As an example, a component mobility may be written as $mob_i(p,m)$, where $mob_i$ is the mobility of component i, p is the pressure, and m is the vector of component mass in a grid block. Meanwhile, the derivatives of $mob_i(p,m)$ are written as $dmob_i/dp$ and $dmob_i/dm$. At the end of a Newton iteration, the component mobility is:

$$mob_i^{n+1} = mob_i^n + dp^{n+1}\frac{dmob_i^n}{dp} + \sum_{j=1}^{nc} dm_j^{n+1}\frac{dmob_i^n}{dm_j}, \tag{3}$$

where $mob_i^n$ is a mobility value for iteration n and component i, $$dp^{n+1}\frac{dmob_i^n}{dp}$$

is the linear change in mobility of component i caused by the change in pressure for iteration n+1, and $$\sum_{j=1}^{nc} dm_j^{n+1}\frac{dmob_i^n}{dm_j}$$

is the sum of linear change in mobility of component i caused by the change in mass of each component for iteration n+1.

If $mob_i^{n+1}$ is less than zero, and $mob_i^n$ is greater than or equal to zero, a damp factor is calculated to modify the solution for the mass change of component i. However, when the solution is damped, the volume balance equation (part of the Jacobian) will likely no longer be satisfied. The volume balance equation equates the volume occupied by the fluid in a grid block, with the pore volume of the grid block. An error in the volume balance can result in a large change in grid block pressure for the next Newton iteration, as the fluid tries to expand or compress to fill the pore volume. This is undesirable because it increases the likelihood that we will again have incorrect flow directions. In at least some embodiments, the mass changes are damped for components whose mobility becomes negative. Also, a damp factor is calculated for the components whose mobility does not become negative, so that the volume balance is preserved. Because the mass/volume balance is a single equation, a single common damp factor (greater or less than 1) is used for the components with mobility greater than or equal to zero. In contrast, the damp factor for the components with negative mobility may be different for each component. If m of the nc components have negative mobility at the end of iteration n+1, and the components have been ordered so that the first m are the components with negative mobility, then the following system of equations is used to determine the damp factors:

$$\begin{bmatrix} dm_j^{n+1}\frac{dmpb_i^n}{dmj} & \sum_{k=m}^{nc} dm_k^{n+1}\frac{dmob_i^n}{dm_k} \\ dm_j^{n+1}\frac{dvolerr^n}{dm_j} & \sum_{\substack{k=m\\+1}}^{nc} dm_k^{n+1}\frac{dvolerr^n}{dm_k} \end{bmatrix}\begin{bmatrix}\alpha_i \\ \beta\end{bmatrix} = \begin{bmatrix}(\varepsilon-1)mob_i^n - \\ dp^{n+1}\frac{dmob_i^n}{dp} \\ -volerr^n\end{bmatrix}, \tag{4}$$

where $\alpha_i$ are the damp factors for mass changes of each of the m components whose mobility becomes negative, $\beta$ is the damp factor for the other nc-m components, $\varepsilon$ is a small number greater than or equal to zero, and usually much less than 1 (i.e., $0 \le \varepsilon < 1$), and volerr is the volume balance error [(Fluid Volume/Pore Volume)−1]. If $\varepsilon$ is greater than zero, the solution will be damped so that the component mobility is slightly positive. The final mass changes for the iteration are then given as:

$$dm_i^* = \alpha_i dm_i, \text{ for } i=1,m \tag{5}$$

$$dm_k^* = \beta dm_k, \text{ for } k=m+1,nc \tag{6},$$

where $dm_i$ is a mass change value for each component with negative mobility, $\alpha_i$ is a separate damp factor for each component with negative mobility, $dm_k$ is a mass change value for each positive mobility component, and $\beta$ is a common damp factor for each positive mobility component. The first line of equation 4 represents m equations for the m components whose mobility becomes negative. The upper right term is an (m×m) sub-matrix with i and j taking the values 1 through m. The second line preserves the volume balance. Note that these equations are applied for every grid block that has negative component mobility, and the values of $\alpha_i$ and $\beta$ will be different for each of these grid blocks.

After solving equation 4, and using a damp factor of 1 for the pressure change, the damped solution for the iteration has no negative component mobility, satisfies the linearized volume balance equation, and has undamped pressure. Because the pressure solution is undamped and the solution satisfies the volume balance, the flow directions for the next Newton iteration are much more reliable and result in fewer flow reversals, if any. The Newton iterations are converged if no component mobility become negative (or are negative within some acceptable tolerance), and other convergence criteria such as the volume balance (after the non-linear update) are smaller than a specified tolerance.

Note that after solving equation 4, the component mobility of one of the nc-m components that had non-negative mobility, might become negative. In this case, it would be necessary to solve equation 4 again, including this component as one of the negative mobility components. Furthermore, it is possible that no value of $\beta$ can be calculated that avoids negative mobility for all components. In this case, the condition of preserving the volume balance is dropped, and damp factors are calculated for all components such that negative mobility is avoided. The worst case is that all values for $\alpha_i$ are zero. If this occurs, then the likelihood of flow reversal is greater because of the volume balance error, but it is still less likely than with other damping schemes.

Figure 4:
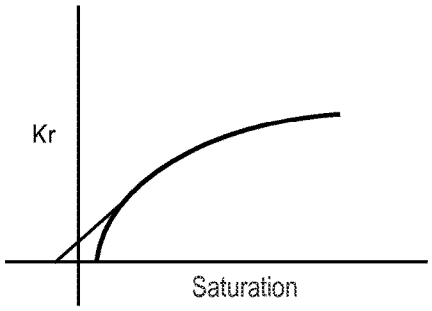
FIG. 4 shows an illustrative convex relative permeability curve.

It is also possible that the linearized mobility of a component (calculated in equation 3) becomes negative only when the mass of the component is less than zero. This can occur if the relative permeability curves are convex, as illustrated in FIG. 4. In this case, the damp factor for this component should be such that the component mass is non-negative. In such case, the damp factor is given as:

$$\alpha_i = ((\varepsilon-1)m_i^n)/dm_i^{n+1} \tag{7},$$

where $m_i^n$ is a mass value of component i for iteration n, and $dm_i^{n+1}$ is a mass change value of component i for iteration n+1. Again, $\varepsilon$ is a small number greater than or equal to zero, and usually much less than 1 (i.e., $0 \le \varepsilon < 1$). In at least some embodiments, equation 7 is applied to equation 4 for each component i.

Figure 5A:
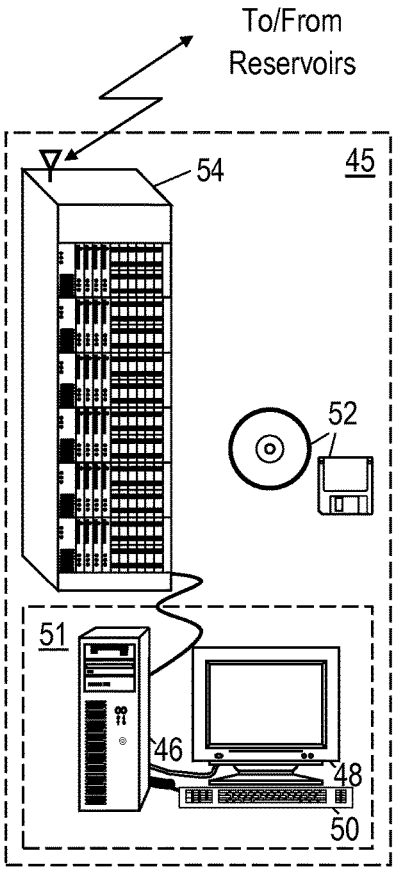
FIGS. 5A-5C shows illustrative production wells and a computer system to control data collection and production.
Figure 5B:
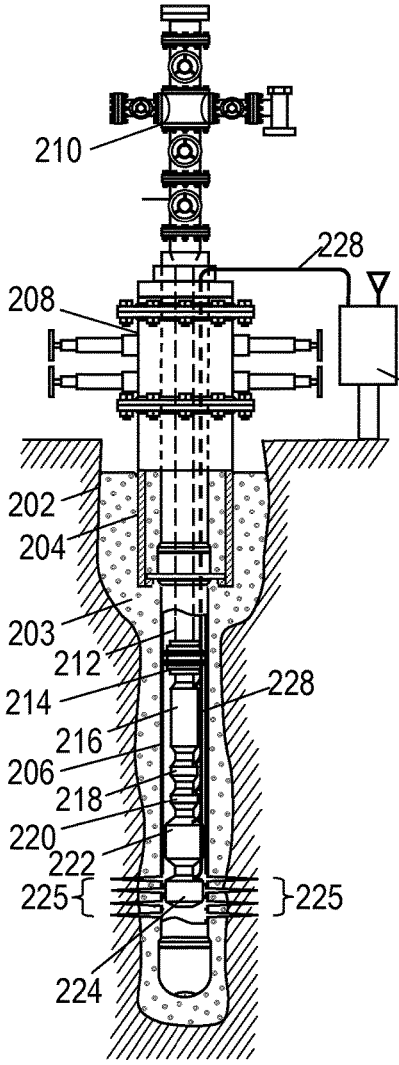
Figure 5C:
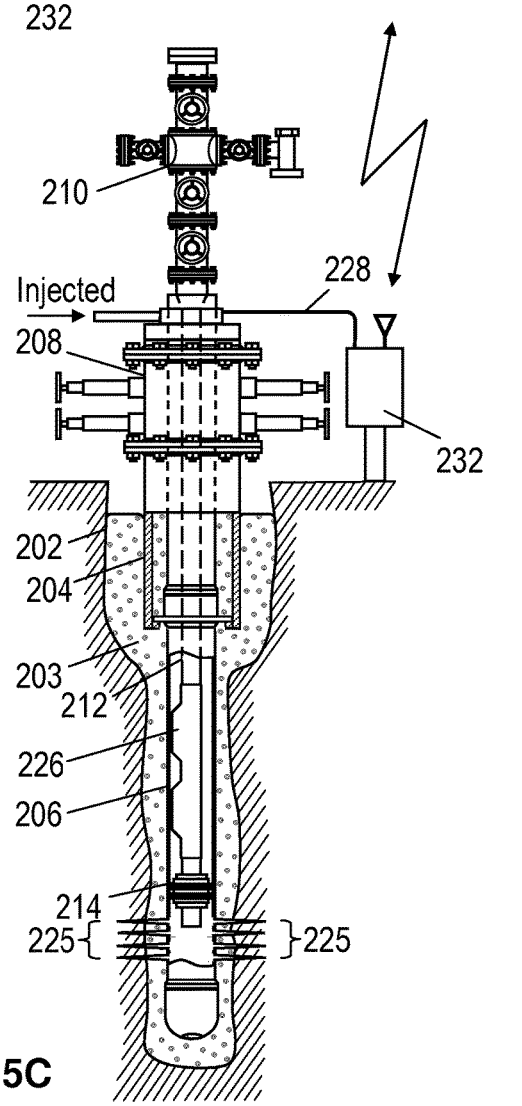

The disclosed non-physical attribute management operations may be combined with other production system management operations to ensure production stays near optimal levels without exceeding facility limits. The systems and methods described herein rely in part on measured data collected from various production system components including fluid storage units, surface network components, and wells, such as those found in hydrocarbon production fields. Such fields generally include multiple producer wells that provide access to the reservoir fluids underground. Further, controllable production system components and/or EOR components are generally implemented at each well to throttle up or down the production as needed. FIGS. 5A-5C show example production wells and a computer system to control data collection and production.

More specifically, FIG. 5B shows an example of a producer well with a borehole 202 that has been drilled into the earth. Such boreholes are routinely drilled to ten thousand feet or more in depth and can be steered horizontally for perhaps twice that distance. The producer well also includes a casing header 204 and casing 206, both secured into place by cement 203. Blowout preventer (BOP) 208 couples to the casing header 204 and to production wellhead 210, which together seal in the well head and enable fluids to be extracted from the well in a safe and controlled manner.

Measured well data is periodically sampled and collected from the producer well and combined with measurements from other wells within a reservoir, enabling the overall state of the reservoir to be monitored and assessed. These measurements may be taken using a number of different downhole and surface instruments, including but not limited to, temperature and pressure sensor 218 and flow meter 220. Additional devices also coupled in-line to production tubing 212 include downhole choke 216 (used to vary the fluid flow restriction), electric submersible pump (ESP) 222 (which draws in fluid flowing from perforations 225 outside ESP 222 and production tubing 212) ESP motor 224 (to drive ESP 222), and packer 214 (isolating the production zone below the packer from the rest of the well). Additional surface measurement devices may be used to measure, for example, the tubing head pressure and the electrical power consumption of ESP motor 224. In the other illustrative producer well embodiment shown in FIG. 5C, a gas lift injector mandrel 226 is coupled in-line with production tubing 212 that controls injected gas flowing into the production tubing at the surface. Although not shown, the gas lift producer well of FIG. 5C may also include the same type of downhole and surface instruments to provide the above-described measurements.

Each of the devices along production tubing 212 couples to cable 228, which is attached to the exterior of production tubing 212 and is run to the surface through blowout preventer 208 where it couples to control panel 232. Cable 228 provides power to the devices to which it couples, and further provides signal paths (electrical, optical, etc.,) that enable control signals to be directed from the surface to the downhole devices, and for telemetry signals to be received at the surface from the downhole devices. The devices may be controlled and monitored locally by field personnel using a user interface built into control panel 232, or may be controlled and monitored by a remote computer system, such as the computer system 45 shown in FIG. 2A and described below. Communication between control panel 232 and the remote computer system may be via a wireless network (e.g., a cellular network), via a cabled network (e.g., a cabled connection to the Internet), or a combination of wireless and cabled networks.

For both of the producer well embodiments of FIGS. 5B and 5C, control panel 232 includes a remote terminal unit (RTU) which collects the data from the downhole measurement devices and forwards it to a supervisory control and data acquisition (SCADA) system that is part of a processing system such as computer system 45 of FIG. 5A. In the illustrative embodiment shown, computer system 45 includes a blade server-based computer system 54 that includes several processor blades, at least some of which provide the above-described SCADA functionality. Other processor blades may be used to implement the disclosed simulation solution systems and methods. Computer system 45 also includes user workstation 51, which includes a general purpose processor 46. Both the processor blades of blade server 54 and general purpose processor 46 are preferably configured by software, shown in FIG. 5A in the form of removable, non-transitory (i.e., non-volatile) information storage media 52, to process collected well data within the reservoirs and data from a gathering network (described below) that couples to each well and transfers product extracted from the reservoirs. The software may also include downloadable software accessed through a communication network (e.g., via the Internet). General purpose processor 46 couples to a display device 48 and a user-input device 50 to enable a human operator to interact with the system software 52. Alternatively, display device 48 and user-input device 50 may couple to a processing blade within blade server 54 that operates as general purpose processor 46 of user workstation 51.

In at least some illustrative embodiments, additional well data is collected using a production logging tool, which may be lowered by cable into production tubing 212. In other illustrative embodiments, production tubing 212 is first removed, and the production logging tool is then lowered into casing 206. In other alternative embodiments, an alternative technique that is sometimes used is logging with coil tubing, in which production logging tool couples to the end of coil tubing pulled from a reel and pushed downhole by a tubing injector positioned at the top of production wellhead 210. As before, the tool may be pushed down either production tubing 212 or casing 206 after production tubing 212 has been removed. Regardless of the technique used to introduce and remove it, the production logging tool provides additional data that can be used to supplement data collected from the production tubing and casing measurement devices. The production logging tool data may be communicated to computer system 45 during the logging process, or alternatively may be downloaded from the production logging tool after the tool assembly is retrieved.

Figure 6:
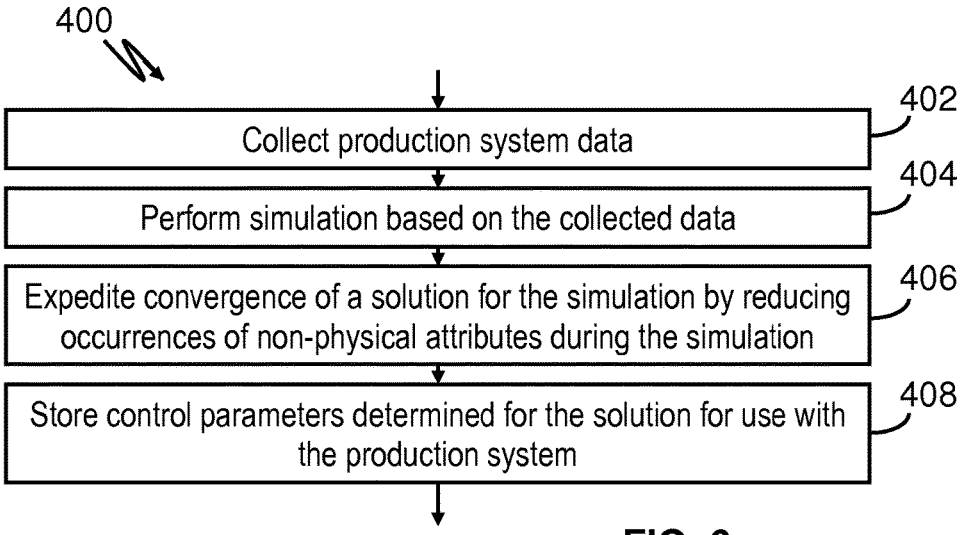
FIG. 6 shows an illustrative hydrocarbon production system method.

FIG. 6 shows an illustrative hydrocarbon production system method 400. The method 400 may be performed, for example, by hardware and software components of computer system 45 or 302 (see FIGS. 5A and 8). The method 400 includes collecting production system data at block 402. Examples of production system data include reservoir data, well data, surface network data, and/or facility data. At block 404, a simulation is performed based on the collected data, a fluid model, and a fully-coupled set of equations. In at least some embodiments, the simulation at block 404 corresponds to the simulation process 10 described in FIG. 1 and/or the operations of simulator 120 described for FIG. 2. The simulation estimates the behavior of the production system at a particular time or during a time range while applying various constraints. At block 406, convergence of a solution is expedited during simulation by reducing occurrences of non-physical attributes as described herein. For example, the step of block 406 involves identifying and accounting for negative mobilities. Without limitation, one or more of equations 3 to 7 discussed previously may be employed to expedite convergence of a simulation solution by reducing occurrences of non-physical attributes. At block 408, control parameters (e.g., for individual wells, surface network components, and/or EOR components) determined for the solution are stored for use with the production system.

Figure 7:
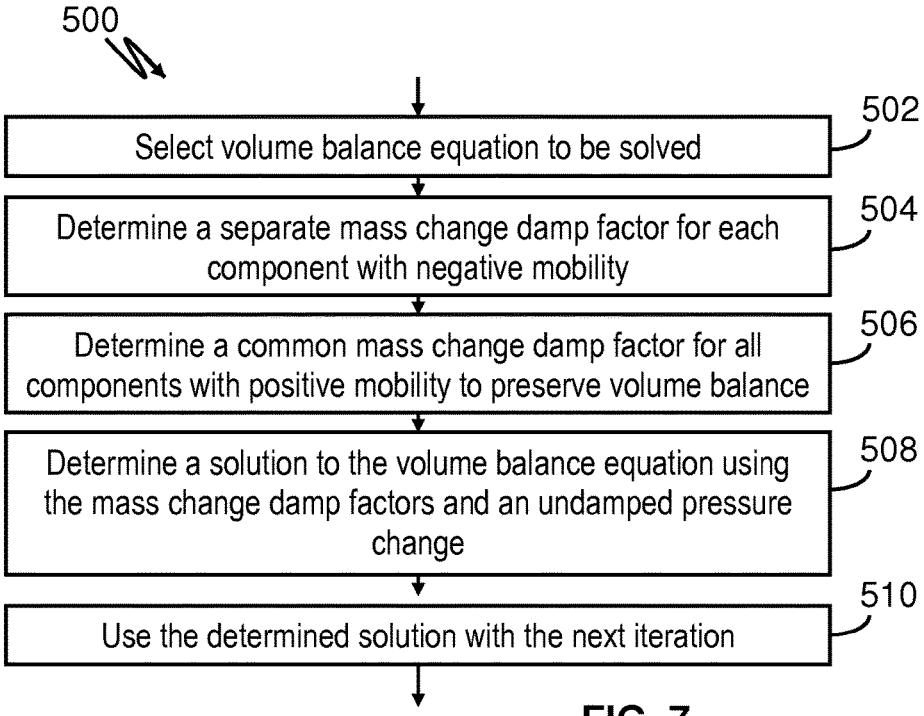
FIG. 7 shows an illustrative non-physical attribute management method.

FIG. 7 shows an illustrative non-physical attribute management method 500. The method 500 may be performed, for example, by hardware and software components of computer system 45 or 302 (see FIGS. 5A and 8). The method 500 includes selecting a volume balance equation to be solved at block 502. At block 504, a separate mass change damp factor is determined for each component with negative mobility at the end of an iteration. At block 506, a common mass change damp factor is determined for all components with positive mobility at the end of an iteration to preserve volume balance. At block 508, a solution to the volume balance equation is determined using the mass change damp factors (i.e., the separate damp factors applied to each component with negative mobility and the common damp factor applied to all components with positive mobility) and an undamped pressure change. At block 510, the determined solution is used with the next iteration.

The process of method 500 may be applied as needed to expedite convergence of a solution for a hydrocarbon production system by reducing the occurrences of non-physical attributes such as negative mass and/or negative saturations. In some cases, a volume balance solution is not possible (i.e., there is no common damp factor applied to components with positive mobility that will balance all components with negative mobility). In such case, the condition of preserving volume balance is dropped, and damp factors are applied such that negative mobility is avoided for all components.

Figure 8:
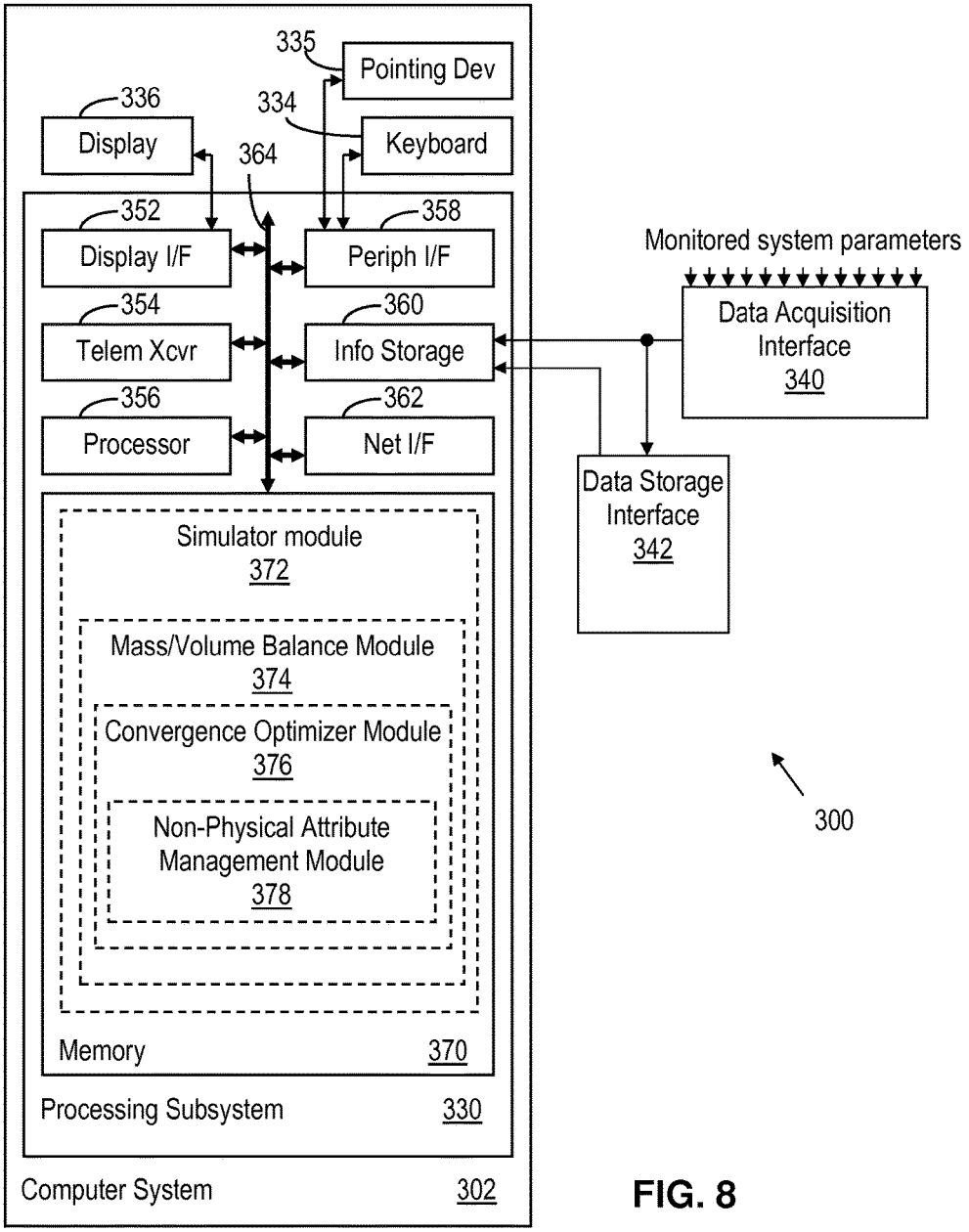
FIG. 8 shows an illustrative control interface for the hydrocarbon production system of FIG. 2.

FIG. 8 shows an illustrative control interface 300 suitable for a hydrocarbon production system such as system 100 of FIG. 2. The illustrated control interface 300 includes a computer system 302 coupled to a data acquisition interface 340 and a data storage interface 342. The computer system 302, data storage interface 342, and data acquisition interface 340 may correspond to components of computer system 45 and/or control panel 232 in FIGS. 5A-5C. In at least some embodiments, a user is able to interact with computer system 302 via keyboard 334 and pointing device 335 (e.g., a mouse) to perform the described simulations and/or to send commands and configuration data to one or more components of a production system.

As shown, the computer system 302 comprises includes a processing subsystem 330 with a display interface 352, a telemetry transceiver 354, a processor 356, a peripheral interface 358, an information storage device 360, a network interface 362 and a memory 370. Bus 364 couples each of these elements to each other and transports their communications. In some embodiments, telemetry transceiver 354 enables the processing subsystem 330 to communicate with downhole and/or surface devices (either directly or indirectly), and network interface 362 enables communications with other systems (e.g., a central data processing facility via the Internet). In accordance with embodiments, user input received via pointing device 335, keyboard 334, and/or peripheral interface 358 are utilized by processor 356 to perform non-physical attribute management operations as described herein. Further, instructions/data from memory 370, information storage device 360, and/or data storage interface 342 are utilized by processor 356 to perform non-physical attribute management operations as described herein.

As shown, the memory 370 comprises a simulator module 372 that includes mass/volume balance module 374. In alternative embodiments, the mass/volume balance module 374 and simulator module 372 are separate modules in communication with each other. The simulator module 372 and mass/volume balance module 374 are software modules that, when executed, cause processor 356 to perform the operations described for the simulation process 10 of FIG. 1 and simulator 120 of FIG. 2. In at least some embodiments, the mass/volume balance module 374 performs the operations described for the mass/volume balancer 122 of FIG. 2. As shown, the mass/volume balance module 374 includes a convergence optimizer module 376 with a non-physical attribute management module 378. In at least some embodiments, the convergence optimizer module 376 and non-physical attribute management module 378 are software modules that, when executed, cause processor 356 to perform the operations described for the convergence optimizer 124 and non-physical attribute manager 126 of FIG. 2. Once a production system solution has been determined using the non-physical attribute management operations described herein, the computer system 502 stores and/or provides control values for use by production system components to control well production operations, EOR operations, and/or other production system operations.

In some embodiments, the determined solution and/or control parameters may be displayed to a production system operator for review. Alternatively, the determined solution and/or control parameters may be used to automatically control production operations of a production system. In some embodiments, the disclosed non-physical attribute management operations are used to plan out or adapt a new production system before production begins. Alternatively, the disclosed non-physical attribute management operations are used to optimize operations of a production system that is already producing.

Numerous other modifications, equivalents, and alternatives, will become apparent to those skilled in the art once the above disclosure is fully appreciated. For example, although at least some software embodiments have been described as including modules performing specific functions, other embodiments may include software modules that combine the functions of the modules described herein. Also, it is anticipated that as computer system performance increases, it may be possible in the future to implement the above-described software-based embodiments using much smaller hardware, making it possible to perform the described non-physical attribute management operations using on-site systems (e.g., systems operated within a well-logging truck located at the reservoir). Additionally, although at least some elements of the embodiments of the present disclosure are described within the context of monitoring real-time data, systems that use previously recorded data (e.g., "data playback" systems) and/or simulated data (e.g., training simulators) are also within the scope of the disclosure. It is intended that the following claims be interpreted to embrace all such modifications, equivalents, and alternatives where applicable.

What is claimed is:

1. A method for a hydrocarbon production system, comprising:

collecting production system data;

performing a simulation based on the collected data, a fluid model, and a fully-coupled set of equations;

expediting convergence of a solution for the simulation by reducing occurrences of non-physical attributes during the simulation, wherein said reducing includes damping mass changes for components with negative mobility and calculating a damp factor for components with positive mobility to preserve volume balance; and outputting control parameters determined for the solution for use with the production system.

2. The method of claim 1, wherein reducing occurrence of non-physical attributes during the simulation comprises calculating a component mobility during iteration n+1 as:

$$mob_i^{n+1} = mob_i^n + dp^{n+1}\frac{dmob_i^n}{dp} + \sum_{j=1}^{nc} dm_j^{n+1}\frac{dmob_i^n}{dm_j},$$

where $mob_i^n$ is a mobility value for iteration n and component i, $$dp^{n+1}\frac{dmob_i^n}{dp}$$

is a linear change in mobility of component i caused by a change in pressure for iteration n+1, and $$\sum_{j=1}^{nc} dm_j^{n+1}\frac{dmob_i^n}{dm_j}$$

is a sum of the linear change in mobility of component i caused by a change in mass of each component for iteration n+1.

3. The method of claim 2, wherein if $mob_i^{n+1}$ is less than zero, and $mob_i^n$ is greater than or equal to zero, a component damp factor is calculated to modify a solution for mass changes to component i.

4. The method of claim 1, wherein the non-physical attributes include a negative mass.

5. The method of claim 1, wherein reducing occurrences of non-physical attributes during the simulation comprises applying a common damp factor for components with mobility greater than or equal to zero, and applying a separate damp factor for each component with mobility less than zero.

6. The method of claim 1, wherein reducing occurrences of non-physical attributes during the simulation comprises, in response to determining that a threshold number of components have a negative mobility, determining damp factors using a volume balance equation:

$$\begin{bmatrix} dm_j^{n+1}\frac{dmob_i^n}{dmj} & \sum_{k=m}^{nc} dm_k^{n+1}\frac{dmob_i^n}{dm_k} \\ dm_j^{n+1}\frac{dvolerr^n}{dm_j} & \sum_{k=m+1}^{nc} dm_k^{n+1}\frac{dvolerr^n}{dm_k} \end{bmatrix}\begin{bmatrix}\alpha_i \\ \beta\end{bmatrix} = \begin{bmatrix}(\varepsilon-1)mob_i^n - \\ dp^{n+1}\frac{dmob_i^n}{dp} \\ -volerr^n\end{bmatrix},$$

where $dm^{n+1}$ is a mass change value for iteration n+1, mobs is a mobility value for iteration n and component i, $$dp^{n+1}\frac{dmob_i^n}{dp}$$

is a linear change in mobility of component i caused by a change in pressure for iteration n+1, $$\sum_{k=m+1}^{nc} dm_k^{n+1}\frac{dmob_i^n}{dm_k}$$

is a sum of linear change in mobility of component k caused by a change in mass of each component for iteration n+1, $\alpha_i$ is a separate damp factor applied to mass changes for each component with negative mobility, β is a common damp factor applied to mass changes for each component with positive mobility, ε is a value greater than or equal to 0 and less than 1, and volerr is a volume balance error.

7. The method of claim 6, wherein damped mass changes for components are determined as:

$$dm_i^* = \alpha_i, \text{ f or i =1,m}$$

$$dm_k^* = \beta dm_k, \text{ f or k =m +1, nc ,}$$

where $dm_i$ is a mass change value for each component with negative mobility, $\alpha_i$ is a separate damp factor for each component with negative mobility, $dm_k$ is a mass change value for each component with positive mobility, and βis a common damp factor for each component with positive mobility.

8. The method of claim 6, further comprising determining a solution for the volume balance equation based on an undamped pressure change and damp factors that eliminate negative component mobilities, and using the determined solution with a next iteration.

9. The method of claim 6, further comprising determining the damp factor $\alpha_i$ as:

$$\alpha_i = (\varepsilon - m_i^n)/dm_i^{n+1},$$

where $m_i^n$ is a mass value of component i for iteration n, and $dm_i^{n+1}$ is a mass change value of component i for iteration n+1, and ε is a value greater than or equal to 0 and less than 1.

10. A hydrocarbon production control system, comprising:

a memory having a non-physical attribute manager; and one or more processors coupled to the memory, wherein the non-physical attribute manager, when executed, causes the one or more processors to:

perform a production system simulation based on a fluid model and a fully-coupled set of equations;

expedite convergence of a solution for the simulation by identifying and accounting for occurrences of non-physical attributes during the simulation, said accounting includes damping mass changes for components with negative mobility and calculating a damp factor for components with positive mobility to preserve volume balance; and output control parameters determined for the solution for use with the production system.

11. The hydrocarbon production control system of claim 10, wherein the non-physical attribute manager, when executed, causes the one or more processors to account for occurrences of non-physical attributes during the simulation by applying at least one damp factor if a component mobility value is determined to change from a positive to a negative during an iteration.

12. The hydrocarbon production control system of claim 11, wherein the at least one damp factor changes non-physical component masses to physical component masses while maintaining volume balance.

13. The hydrocarbon production control system of claim 10, wherein the non-physical attribute manager, when executed, causes the one or more processors to ignore a condition to preserve volume balance in response to a determination that a damping alone does not eliminate negative mobility for all components.

14. The hydrocarbon production control system of claim 10, wherein the non-physical attribute manager, when executed, causes the one or more processors to determine a separate damp factor for each of the components with negative mobility.

15. The hydrocarbon production control system of claim 10, wherein the non-physical attribute manager, when executed, causes the one or more processors to determine a single common damp factor for the components with positive mobility, wherein the single common damp factor preserves the volume balance.

16. The hydrocarbon production control system of claim 10, wherein the non-physical attribute manager, when executed, causes the one or more processors to determine a solution for a volume balance equation based on an undamped pressure change and damp factors that eliminate negative component mobilities, and to use the determined solution with a next iteration.

17. A non-transitory computer-readable medium that stores non-physical attribute management software, wherein the software, when executed, causes a computer to:

perform a production system simulation based on a fluid model and a fully-coupled set of equations;

account for negative component mobilities during the simulation by applying a set of damp factors to component mass changes in a mass volume balance equation, wherein said applying includes damping mass changes for components with negative mobility and calculating a damp factor for components with positive mobility to preserve volume balance; and output control parameters determined by the simulation for use with the production system.

18. The non-transitory computer-readable medium of claim 17, wherein the software, when executed, causes the computer to determine a solution for the mass volume balance equation based on undamped pressure change and the set of damp factors, and to use the determined solution with a next iteration.

19. A method for a hydrocarbon production system, comprising:

collecting production system data;

performing a simulation based on the collected data, a fluid model, and a fully-coupled set of equations;

expediting convergence of a solution for the simulation by reducing occurrences of non-physical attributes during the simulation;

outputting control parameters determined for the solution for use with the production system; and dropping a condition to preserve volume balance in response to determining that no value of $\beta$ avoids negative mobility for all components, wherein the non-physical attributes includes a negative mass, and $\beta$ is a common damp factor applied to mass changes for each component with positive mobility.

20. A non-transitory computer-readable medium that stores non-physical attribute management software, wherein the software, when executed, causes a computer to:

perform a production system simulation based on a fluid model and a fully-coupled set of equations;

account for negative component mobilities during the simulation by applying a set of damp factors to component mass changes in a mass volume balance equation;

output control parameters determined by the simulation for use with the production system; and ignore a condition to preserve volume balance in response to a determination that a damping alone does not eliminate negative mobility for all components.

* * * * *